US011957191B2

(12) United States Patent
Goldberg-Poch et al.

(10) Patent No.: US 11,957,191 B2
(45) Date of Patent: Apr. 16, 2024

(54) CLIMBING GLOVES

(71) Applicant: 0950300 B.C. Ltd, Squamish (CA)

(72) Inventors: Zachary Goldberg-Poch, Squamish (CA); Nathan Kukathas, Squamish (CA)

(73) Assignee: 0950300 B.C. LTD., Squamish (CA)

( * ) Notice: Subject to any disclaimer, the term of this patent is extended or adjusted under 35 U.S.C. 154(b) by 0 days.

(21) Appl. No.: 17/341,006

(22) Filed: Jun. 7, 2021

(65) Prior Publication Data

US 2021/0386132 A1 Dec. 16, 2021

Related U.S. Application Data

(60) Provisional application No. 63/038,085, filed on Jun. 11, 2020.

(51) Int. Cl.
*A41D 13/08* (2006.01)
*A41D 31/02* (2019.01)

(52) U.S. Cl.
CPC ..... *A41D 13/084* (2013.01); *A41D 31/02* (2013.01); *A41D 2300/32* (2013.01); *A41D 2500/20* (2013.01)

(58) Field of Classification Search
CPC .... A41D 13/084; A41D 13/08; A41D 13/081; A41D 19/0017; A41D 19/001; A63B 21/4019; A63B 71/141; A63B 71/14; A41F 1/06
USPC ..... 2/161.1
See application file for complete search history.

(56) References Cited

U.S. PATENT DOCUMENTS 460,463 A * 9/1891 Conway et al. ..... A41D 13/082 2/166
632,547 A * 9/1899 Barth ..... A41D 19/01 2/158
1,200,580 A 10/1916 Brenner
1,658,113 A * 2/1928 Young ..... A41D 19/02 2/161.8

(Continued)

OTHER PUBLICATIONS

Best Crack Climbing Gloves: A comprehensive guide, Adventure Protocol, Oct. 28, 2019, pp. 1 to 9. Retrieved on Dec. 3, 2019 from www.adventureprotocol.com/best-crack-climbing-gloves/.

(Continued)

*Primary Examiner* — Jillian K Pierorazio
(74) *Attorney, Agent, or Firm* — Oyen Wiggs Green & Mutala LLP; Nicholas Garner

(57) ABSTRACT

There is provided an open-palmed glove. The glove includes a first layer of material. The glove includes a second layer of material coupled to and extending about peripheral portions of the first layer of the material. There is also provided an open-palmed glove comprising a single material in the form of one of leather, leather suede, synthetic leather, and microfiber, with a lining coupled to said single material and forming an aperture aligned with the back of the glove. There is yet further provided use of an open-palmed glove for rock climbing. The glove consists of a single material on the back thereof. The single material touches both the hand and a rock that is being climbed. There is yet additionally provided a kit comprising a plurality of pairs of rock-climbing gloves of different sizes, each having its own color which corresponds to a color of a camming device.

19 Claims, 9 Drawing Sheets

(56) References Cited

U.S. PATENT DOCUMENTS

| | | | | | |
|---|---|---|---|---|---|
| 1,966,822 | A | | 7/1934 | Lieb | |
| 2,011,362 | A | | 8/1935 | Hayward | |
| 2,547,388 | A | | 4/1951 | Griffin | |
| 2,581,549 | A | | 1/1952 | McGaugh | |
| 3,037,209 | A | | 6/1962 | Applegate, Jr. et al. | |
| 3,178,724 | A | | 4/1965 | Perschke | |
| 3,217,332 | A | | 11/1965 | Gross | |
| 3,486,171 | A | | 12/1969 | Zierhut | |
| D267,129 | S | * | 12/1982 | Kneisley | D29/113 |
| 4,785,478 | A | * | 11/1988 | Mosley | A41D 13/084 2/167 |
| 5,070,541 | A | | 12/1991 | Goss | |
| 5,079,776 | A | * | 1/1992 | Crawford | A63B 71/141 2/167 |
| 5,125,115 | A | * | 6/1992 | Lincoln | A41D 31/14 2/159 |
| 5,459,883 | A | * | 10/1995 | Garceau-Verbeck | A63B 71/146 2/161.4 |
| D380,874 | S | | 7/1997 | Caswell | |
| D387,503 | S | * | 12/1997 | Ho | D2/610 |
| D396,936 | S | * | 8/1998 | Liss-Daniels | D2/610 |
| 6,035,443 | A | * | 3/2000 | Green | A63B 71/146 2/907 |
| 6,374,416 | B1 | * | 4/2002 | Baranauskas | A41D 13/087 2/161.5 |
| D502,573 | S | * | 3/2005 | Jones | D29/113 |
| D619,306 | S | * | 7/2010 | Yang | D29/113 |
| 8,060,948 | B2 | | 11/2011 | Pesic | |
| 8,863,312 | B1 | * | 10/2014 | Gary | A41D 19/01547 2/20 |
| 9,480,902 | B2 | * | 11/2016 | House | A63B 71/145 |
| 9,820,516 | B2 | | 11/2017 | Ferrer | |
| 10,576,356 | B1 | | 3/2020 | Pellegrino | |
| D889,068 | S | | 7/2020 | Nack | |
| 2013/0000006 | A1 | * | 1/2013 | Norton | A63B 71/145 2/16 |
| 2015/0103400 | A1 | | 4/2015 | Porooshani | |
| 2015/0283451 | A1 | * | 10/2015 | Ramirez | A63B 71/141 2/161.1 |
| 2016/0367881 | A1 | * | 12/2016 | Le | A41F 1/06 |
| 2017/0336167 | A1 | * | 11/2017 | Carlston | A63B 71/14 |
| 2019/0208845 | A1 | * | 7/2019 | Gellis | D04B 1/102 |
| 2019/0364997 | A1 | * | 12/2019 | Chen | B32B 25/10 |
| 2020/0022429 | A1 | * | 1/2020 | Nack | A41D 19/0048 |
| 2021/0368894 | A1 | * | 12/2021 | Scianna | A41D 19/0034 |

OTHER PUBLICATIONS

Black Diamond Crack Gloves as shown on the following archived website of Mar. 10, 2020: https://www.mountainproject.com/forum/topic/118636918/bd-crack-gloves.

OR Outdoor Research: Splitter Gloves, dated Aug. 29, 2019: https://www.outdoorresearch.com/us/splitter-gloves-264361.

Dick's Climbing Bristol: dated Jan. 15, 2019: https://www.dicksclimbing.com/products/ocun-crack-glove.

Hand Jam, posted at g7equipment.com, posting date not given, [online], [site visited on May 5, 2022]. Available from Internet, URL: https ://g7equipment.com/products/handjam (Year: 2022).

Red Chili Jamrock climbing gloves, posted at amazon.com, posting date Feb. 23, 2021, [online], [site visited May 5, 2022]. Available from Internet, URL: https://www.amazon.com/Red-Chili-Jamrock/dp/B08X6TVLF7?th=1 (Year: 2021).

* cited by examiner

CLIMBING GLOVES

BACKGROUND OF THE INVENTION

Field of the Invention

There is provided one or more climbing gloves. In particular, there is provided a pair of climbing gloves for crack climbing.

Description of the Related Art

U.S. Pat. No. 632,547 to Barth discloses a hand-shield comprising a flexible back-piece confirming to the shape of the back of the hand and the edges thereof. The hand-shield includes finger covers projecting from the top of the back-piece. The hand-shield includes a thumb cover secured upon the back-piece. The hand-shield includes an elastic band secured upon the hand-shield to gores that project between the adjacent edges of the finger-covers so as to hold said covers imposed upon the fingers. The hand-shield includes an elastic keeper-band on the thumb-cover adapted to retain it in place. The hand-shield includes means to detachably secure the lower portion of the hand-shield upon the wrist of the wearer.

U.S. Pat. No. 5,070,541 to Goss discloses a protective covering protecting the back of the hand and forearm, while leaving the palm, fingers, and thumb uncovered to be used. The loops around the forefinger, pinky finger and thumb secure the protection in place on the back of the hand. The fastener at the inner wrist provides the protection with comfortable bending of the wrist. The fasteners along the length of the forearm secure the invention around the forearm. The protection can be put on quickly and solely, therefore to be useful and practical.

U.S. Pat. No. 5,079,776 to Crawford discloses a glove for use in rock climbing. The glove includes a pad made from a rubber material that is flexible and has a breakaway friction greater than about 30 to 35 pounds. At least a portion of the pad is exposed for use in contacting a rock surface when the glove is used in lock climbing.

BRIEF SUMMARY OF INVENTION

There is provided, and it is an object to provide, an improved climbing glove.

There is accordingly provided an open-palmed glove. The glove includes a first layer of material. The glove includes a second layer of material coupled to and extending about peripheral portions of the first layer of the material.

There is also provided a glove having an open palm and a back opposite the open palm. The glove includes finger and strap portions made of one or more reinforcing materials. The glove includes a central portion extending along the back of the glove. The central portion consists of a single layer of material.

There is further provided an open-palmed glove comprising a first member and a second member. The first member is made of one of leather, leather suede, synthetic leather, and microfiber. A central portion of a back of the glove consists of the first member. The second member is made of a reinforcing material. The second member couples to the first member. In this example the second member is bonded, laminated and/or glued to the first member; however this is not strictly required and the second member may couple to the first member in other manners in other embodiments. The second member extends about finger and strap portions of the glove.

There is additionally provided an open-palmed glove comprising a single material in the form of one of leather, leather suede, synthetic leather, and microfiber. The glove further including a lining coupled to said single material. The lining forms an aperture aligned with the back of the glove such that the back of the glove consists of said single material and is unlined.

There is yet also provided an open-palmed glove comprising a dorsal portion consisting of a single layer of a first material. The glove includes a plurality of finger portions coupled to a first peripheral edge of the dorsal portion of the glove. The finger portions are made of at least a second material. The glove includes a strap portion coupled to a second peripheral edge of the dorsal portion of the glove. The strap portion is made of at least said second material.

There is yet further provided use of an open-palmed glove for rock climbing. The glove consists of a single material on the back thereof. The single material touches both the hand and a rock that is being climbed.

There is yet additionally provided a kit comprising a plurality of pairs of rock-climbing gloves of different sizes and of the type as described above. Each size of rock-climbing gloves has its own color which corresponds to a color of a camming device.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 4:
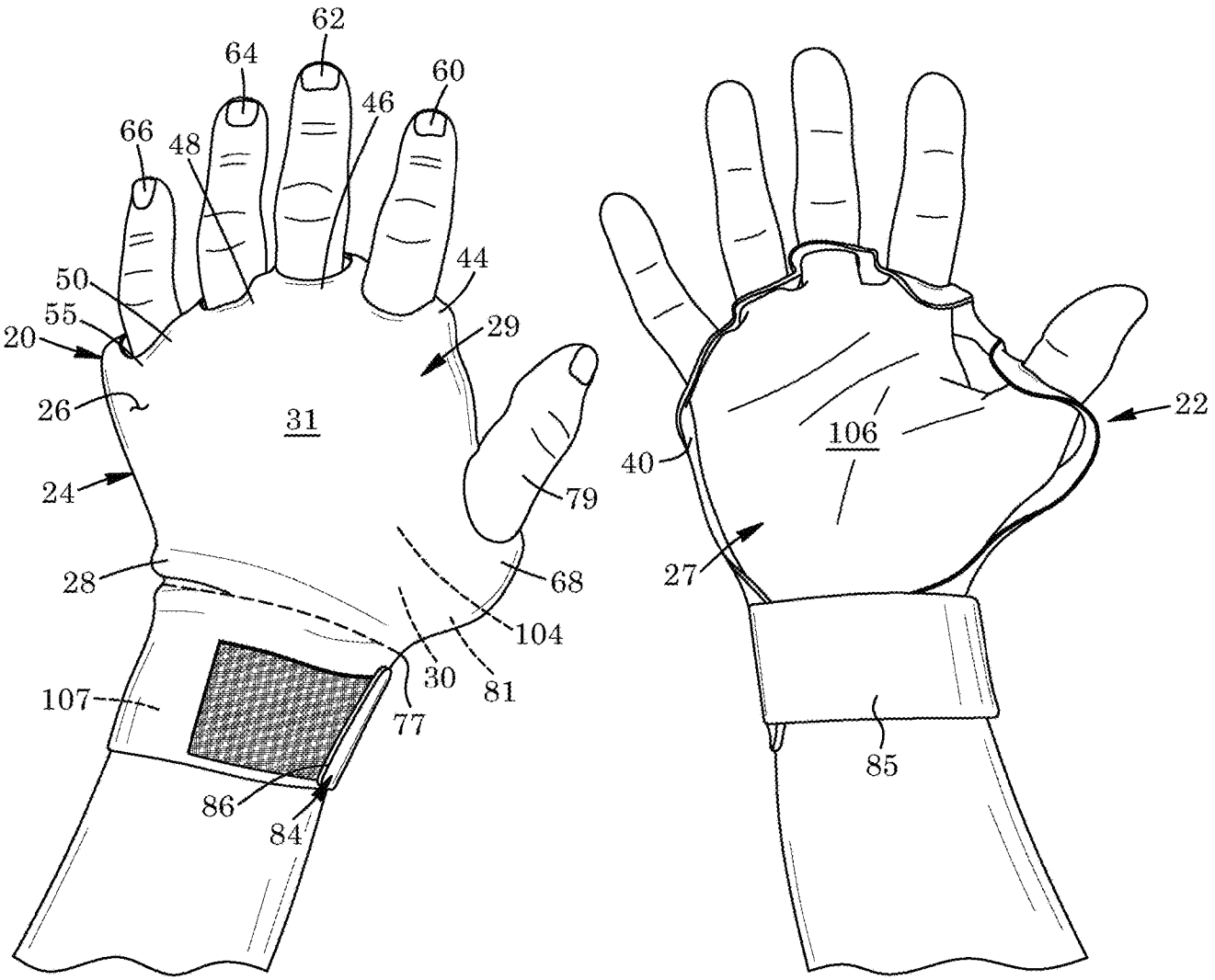
FIG. 4 shows a dorsal perspective view of the left hand one of the gloves extending about a left hand of a person and a palmar perspective view of a right hand one of the gloves extending about a right hand of the person.

Referring to the drawings and first to FIG. 4, there is shown at least one, in this example a pair of open-palmed gloves 20 and 22. Each glove is substantially the same in parts and function, with glove 20 being a mirror image of glove 22. Accordingly, only glove 20 will be described in detail.

Figure 1:
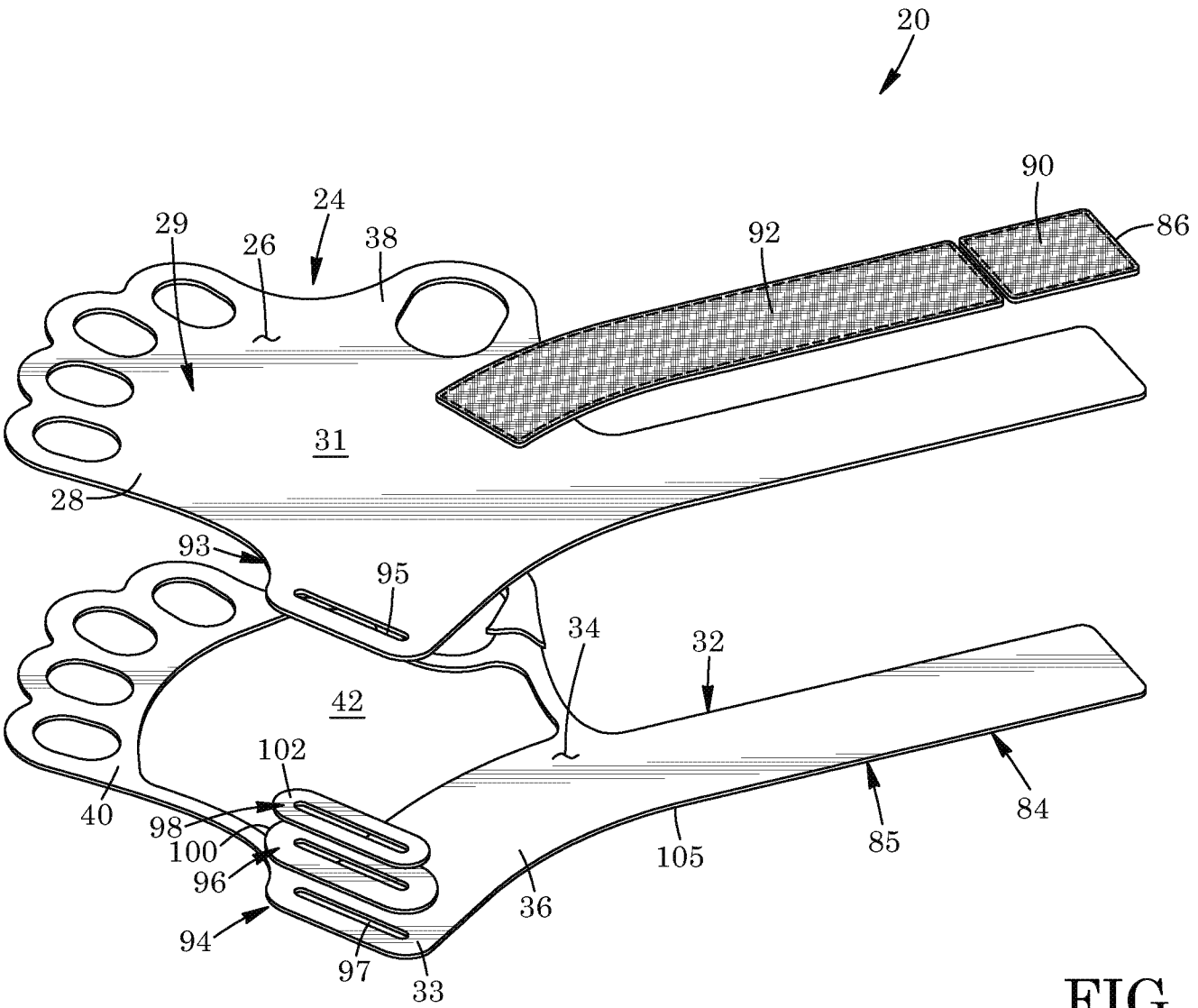
FIG. 1 is an exploded dorsal side perspective view of a left hand one of a pair of open-palmed gloves of FIG. 4 according to a first aspect.

As seen in FIG. 1, each glove 20 includes a first flexible member 24 formed by a single or first layer 26 of material 28. Member 24 is planar when the glove is not in use in this example and may be referred to as a first flexible planar member; however the member need not be planar or entirely planar in other embodiments when not in use. The first layer of material is breathable and configured to provide abrasion resistance. As seen in FIG. 4, the first layer 26 of material 28 is configured to stretch and may mold to one's hand 30. Material 28 is one from the group of leather, leather suede, synthetic leather, and microfiber in this example. As seen in FIG. 4, each glove 22 has an open palm 27 and a dorsal side or back 29 opposite the open palm. Each glove 20 includes a central portion 31 thereof extending along the back 29 thereof and consisting of the first member 24 in the form of said single or first layer 26 of material 28.

As seen in FIG. 1, each glove 20 includes a second flexible member 32 formed by a second layer 34 of material 36, in this example a reinforcing material 36. Member 32 is planar when the glove is not in use in this example and may be referred to as a second flexible planar member; however the member need not be planar or entirely planar in other embodiments when not in use. The second flexible member couples to and extends about peripheral portions 38 of the first layer 26 of the material 28.

Figure 2:
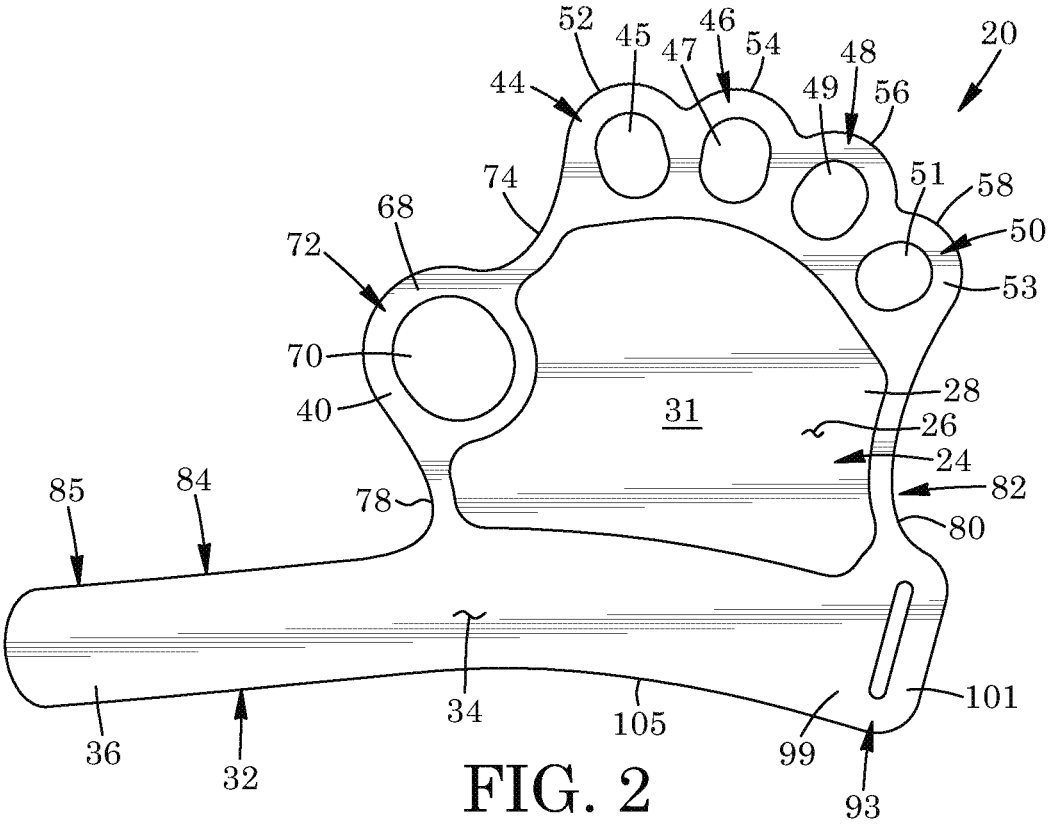
FIG. 2 is a palmar side plan view thereof.
Figure 3:
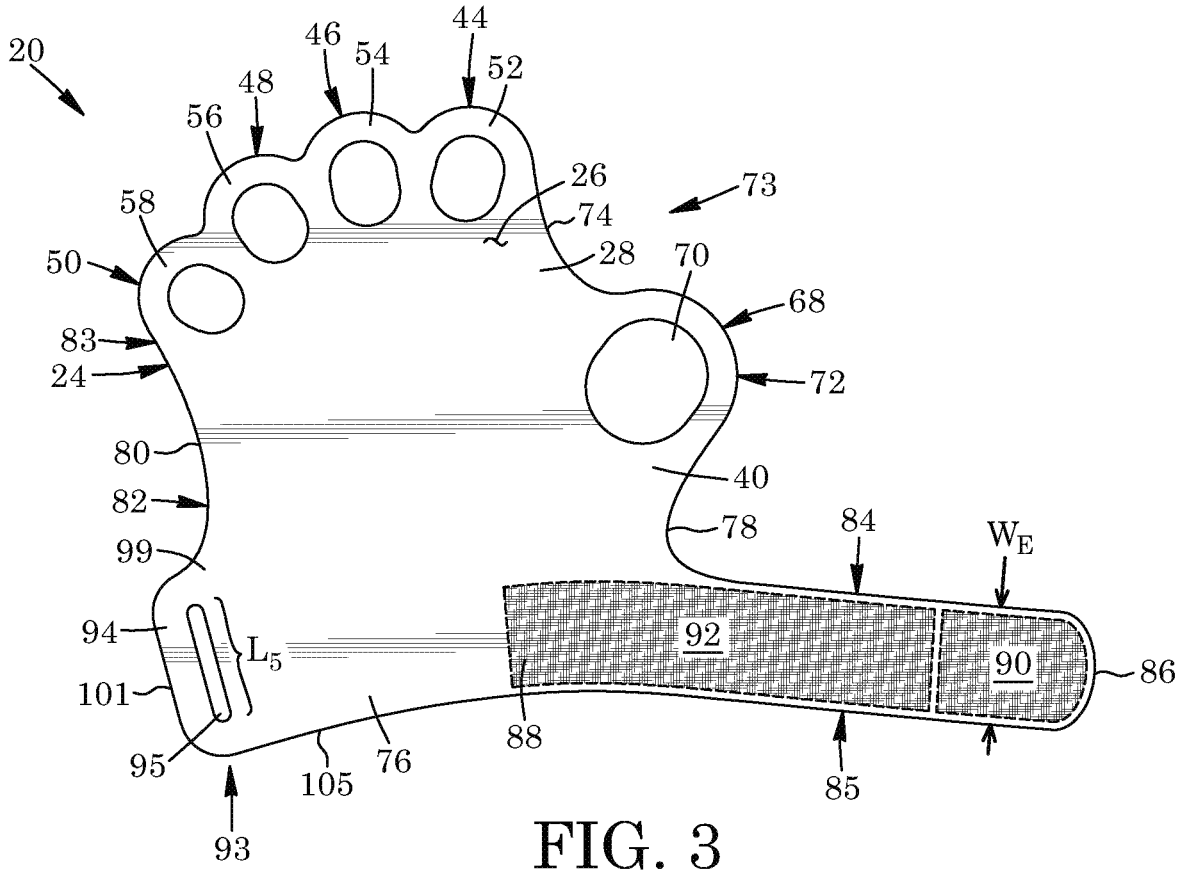
FIG. 3 is a dorsal side plan view thereof.

As seen in FIGS. 2 and 3, the first layer 26 of material 28 and second layer 34 of material 36 are co-planar at least in part in this example when the glove 20 is not in use. The second layer of material functions to reinforce the first layer of material. The glove includes a lining 40 which is part of the second member 32 and which is formed by the second layer 34 of material 36. The lining may be a thin knit or woven material (e.g. a mix of nylon fibers, polyurethane fibers and/or polyurethane fabric), a thin non-woven material (e.g. microfiber), or a thin polymer (e.g. PVC, polyurethane film or the like). The latter may be a polymer laminate or painted-on polymer for example. However, this is not strictly required, the listed examples are not intended to be limiting, and the lining 40 may comprise any flexible and/or high-strength material.

As seen in FIG. 1, the lining has an aperture 42 extending therethrough in this example. However, this is not strictly required as a central opening may be formed in other manners in other examples. The aperture 42 is aligned with the back 29 of the glove 20 such that the back of the glove consists of the first layer 26 of material 28 and is unlined. The second member 32 thus may be said to have said aperture 42 that extends about the central portion 31 of the glove.

As seen in FIG. 2, the glove 20 has a plurality of finger portions 44, 46, 48 and 50. The finger portions have a plurality of apertures 45, 47, 49 and 51, respectively, extending through a distal or finger region 53 of the glove. As seen in FIG. 4, the finger portions couple to and are integrally formed with a first or distal peripheral edge 55 of the back of the glove 29. The finger portions 44, 46, 48 and 50 are generally annular. As seen in FIG. 2, the finger region of each glove 20 comprises a plurality of outwardly convex arc-shapes 52, 54, 56 and 58 in this example. The radius of curvature of each arc-shape is approximately the same in this example. The finger portions 44, 46, 48 and 50 of the glove 20 are integrally connected together and form an integrated whole in this example, with each finger portion being loop-shaped. As seen in FIG. 4, the finger portions are shaped to receive and extend about the bases of one's index finger 60, middle finger 62, ring finger 64 and pinky finger 66.

As seen in FIG. 3, each glove 20 includes a thumb portion 68. The thumb portion has an aperture 70 extending through a first or thumb region 72 of the glove. The thumb portion 68 is generally annular and loop-shaped. The aperture 70 of the thumb portion of the glove 20 is larger in span and diameter and has a larger radius of curvature compared to the apertures 45, 47, 49 and 51 of the finger portions 44, 46, 48 and 50 in this example. The thumb portion couples to and is integrally formed with the finger portion 44 of the glove via a first or distal, outwardly concave connector portion or web 74 of the thumb region 72 of the glove in this example located adjacent first side 73 of the glove.

The glove 20 includes a proximal or wrist portion 76 which is generally rectangular in shape in this example. As seen in FIG. 4, the wrist portion couples to and is integrally formed with a second peripheral edge 77 of the back 29 of the glove. The wrist portion 76 may thus be said to be a part of the back of the glove. As seen in FIG. 3, the thumb portion 68 of the glove 20 couples to and is integrally formed with the wrist portion of the glove via a second or proximal, outwardly concave connector portion or web 78 of the thumb region 72 of the glove in this example. The second web has a smaller radius of curvature compared to that of the first web 74 in this example.

As seen in FIG. 4, the thumb portion of the glove is shaped to receive and extend about the base 81 of one's thumb 79. As seen in FIG. 3, finger portion 50 of the glove 20 couples to and is integrally formed with the wrist portion 76 of the glove via a third outwardly concave connector portion or web 80 located adjacent pinky region 82 and second side 83 of the glove. The second side of the glove is spaced-apart from the first side 73 of the glove. The third web 80 extends a greater distance compared to the first web 74 and the second web 78 in this example. The third web has a larger radius of curvature compared to that of the first web and the second web in this embodiment.

As seen with reference to FIGS. 2 and 3, the finger portions 44, 46, 48 and 50, thumb portion 68 and wrist portion 76 of each glove 20 are integrally connected together and form a unitary whole in this example, and are made of both the first layer 26 of material 28 and second layer 34 of material 36.

Referring to FIG. 3, the wrist portion 76 of the glove 20 includes a strap 84 comprising a first elongate portion 85 coupled to and extending outwards from the thumb region 72 of the glove. The first elongate portion of the strap is generally rectangular in this example and a width $W_E$. The first elongate portion 85 of the strap 84 has a first, distal or outer end 86 and a second, proximal or inner end 88. Each glove 20 in this example includes a first of hook and loop fasteners 90 coupled to the strap thereof and extending from the outer end of the strap towards the inner end of the strap. Each glove in this example includes a second of hook and loop fasteners 92 coupled to the strap and extending from the inner end 88 of the strap towards the outer end 86 of the strap.

Still referring to FIG. 3, the strap 84 includes a second elongate portion 93 which forms a strap loop 94. The second elongate portion of the strap couples to the pinky region 82 via a first, proximal or inner end 99 thereof and has a second, distal or outer end 101 spaced-apart from the inner end thereof. The outer end of the second elongate portion 93 of the strap 84 aligns near finger portion 50.2 in this example.

As seen in FIG. 1, the strap loop in this example comprises first layer 26 of material 28 with a slot 95 extending therein, second layer 34 of material 36 with a corresponding slot 97 extending therein, and an additional third layer 96 and fourth layer 98 of strength materials 100 and 102 in this example, each of which is loop-shaped and all of which are coupled together, in this case via adhesive 33. The slot has a length $L_S$ equal to or greater than the width $W_E$ of the first elongate portion 85 of the strap 84.

As seen in FIG. 3, the glove 20 has a fourth outwardly concave connector portion or web 105 extending between, coupling together and being integrally formed with the strap loop 94 and outer end 86 of strap 84 in this example; however, this is not strictly required. The fourth web extends a greater distance compared to the first web 74, the second web 78 and the third web 80 in this example. The fourth web 105 has a larger radius of curvature compared to that of the first web, the second web and the third web in this embodiment.

Figure 5:
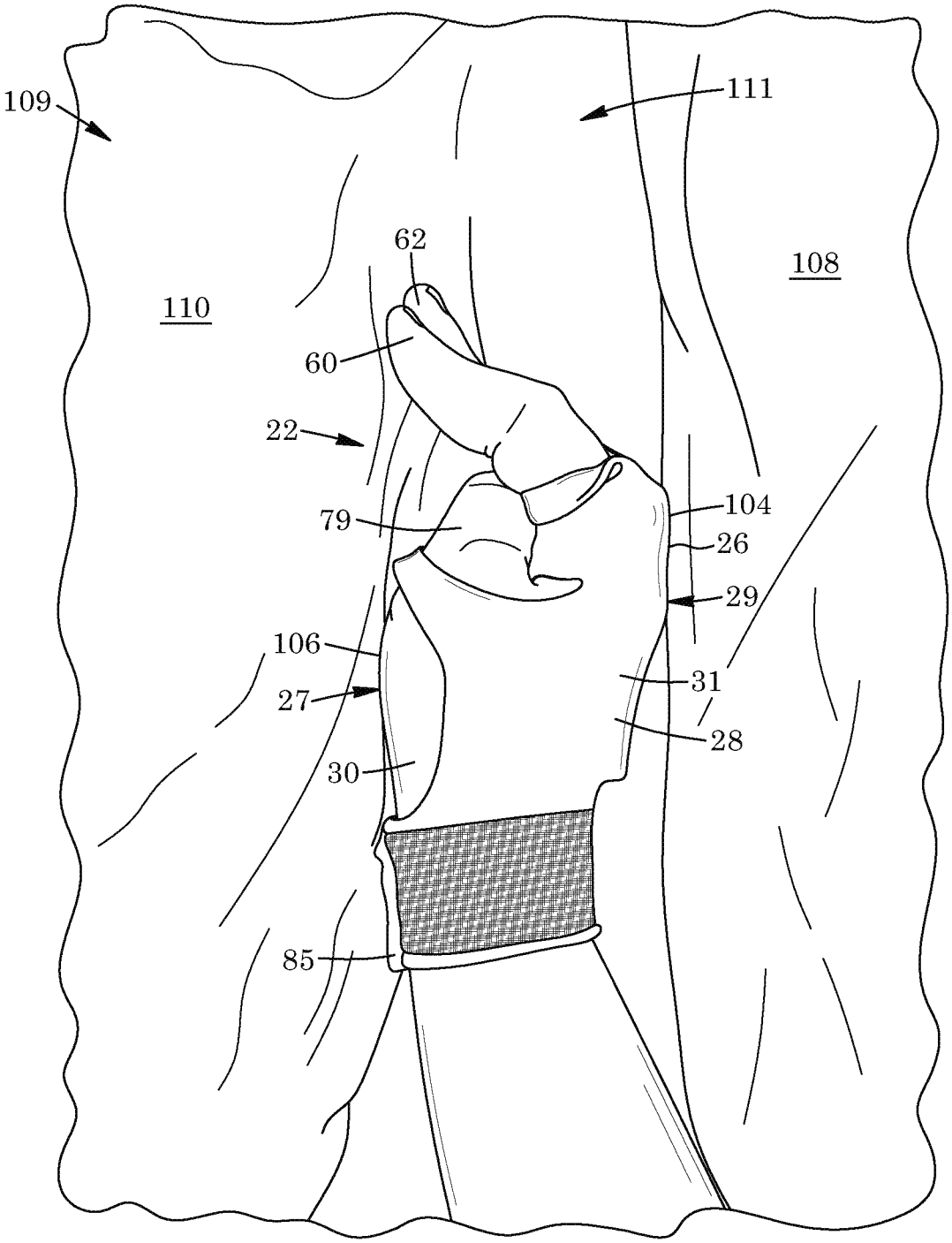
FIG. 5 is a side perspective view of a cliff face with a crack extending therein, and the right hand of the person of FIG. 4 with the glove of FIG. 4 thereon and positioned within said crack.
Figure 6:
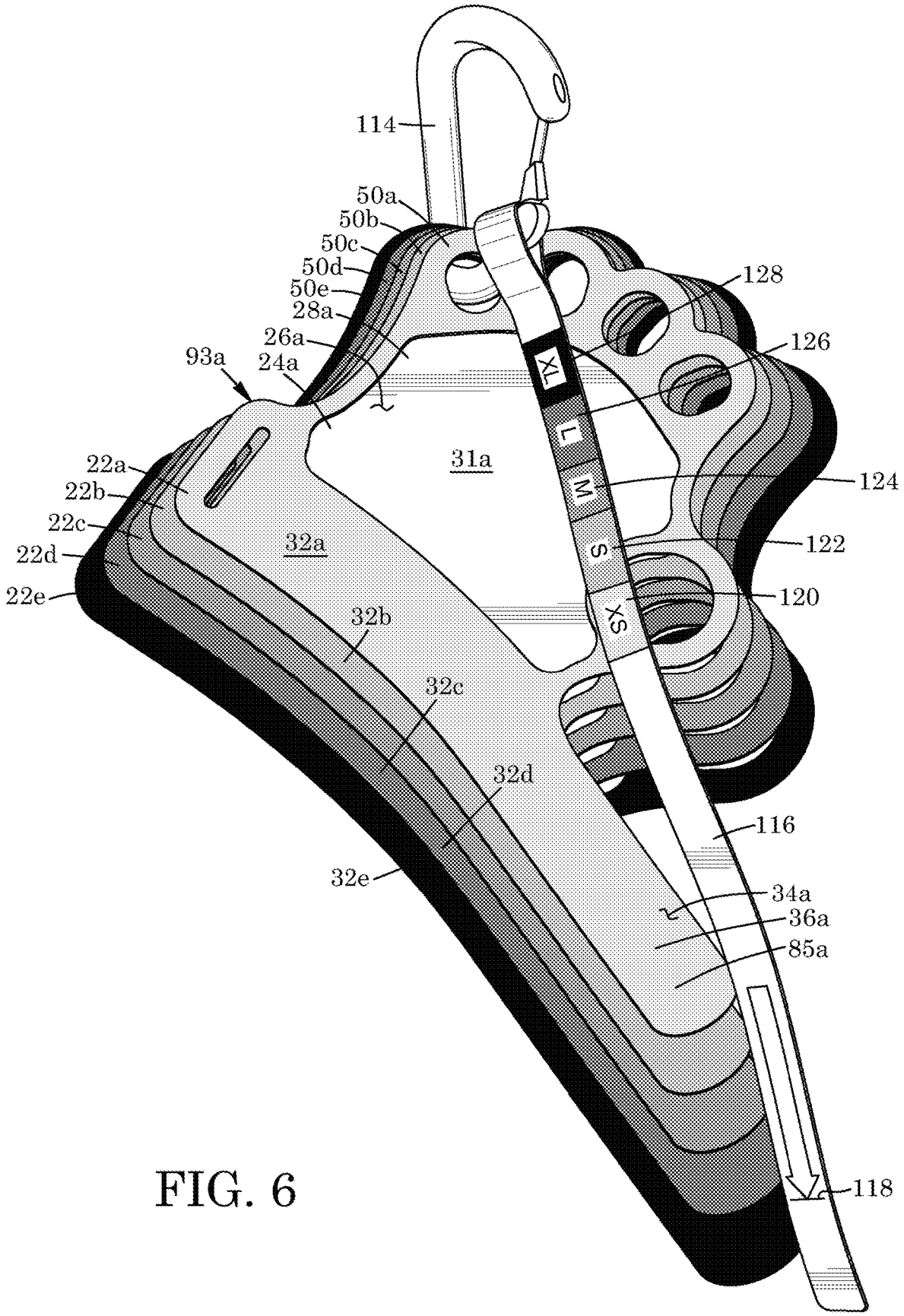
FIG. 6 is a kit comprising a plurality of gloves of the type of FIG. 1 of different sizes and corresponding different colors, the gloves being coupled together via a carabiner, and the kit further including a hand size measuring strap.

In operation and referring to FIG. 4, the gloves 20 and 22 are shaped enable one's fingers 60, 62, 64 and 66 and thumb 79 to extend therethrough. The gloves are shaped to cover the back or dorsal side 104 of the hand 30, leaving the palm 106 of the hand exposed. Strap 84 wraps around one's wrist 107 with end 86 of strap fitting through slot 95 of strap loop 94 seen in FIG. 3, and then looping back such that first of the hook and loop fasteners 90 selectively couple to second of the hook and loop fasteners 92. The gloves 20 and 22 securely couple to one's hands 30 seen in FIG. 4 thereby Referring to FIG. 5, there is thus provided a pair of open-palmed gloves 20 and 22 for rock climbing, in this case crack climbing. FIG. 5 shows a cliff face 109 comprising first rock or rock portion 108 and a second rock or rock portion 110 adjacent to the first rock portion, with a gap, in this example a fissure or crack 111 extending therebetween. The gloves 22 in use and when worn are shaped to be inserted in said cracks and facilitate crack climbing thereby. Each glove consists of said single material 28, in this example leather on the back 29 thereof in said central portion 31 thereof, with the leather touching both the hand 30 and rock portion 108 that is being climbed. The glove enables fingers 60 and 62, thumb 79 and palm 106 to be exposed and touch rock portion 110 when crack climbing, with one's hand 30 thus being wedged between rock portions 108 and 110. Crack climbing per se is known to those skilled in the art and will not be described in detail.

There is further provided a kit 112 comprising a plurality of rock-climbing gloves 22*a*, 22*b*, 22*c*, 22*d* and 22*e* of different sizes. Each of the gloves is substantially similar to gloves 22 described in FIGS. 1 to 5, with like parts having like numbers and functions with the additional of alphabetical letter extension ".a", ".b", ".c", ".d" and ".e". The gloves are coupled together via a carabiner 114 in this example which extends through finger portions 50*a*, 50*b*, 50*c*, 50*d* and 50*e* thereof. Each size of rock-climbing gloves has its own color which corresponds to a color and size of a corresponding camming device in this example.

The kit 112 further includes a hand measuring size strap 116. The strap is extendable about the palmar and dorsal portions of one's hand between the fingers and thumb thereof, with the extent of strap required determining an appropriate a glove size. The strap has a first indicia 118 for aligning with a first part of one's hand, and a plurality of indicia size ranges or bands 120, 122, 124, 126 and 128 for aligning with a second part of one's hand Glove size for a given hand is determined based on where within a given indicia band said indicia 118 meets when the strap is thus wrapped around one's hand.

Figure 7:
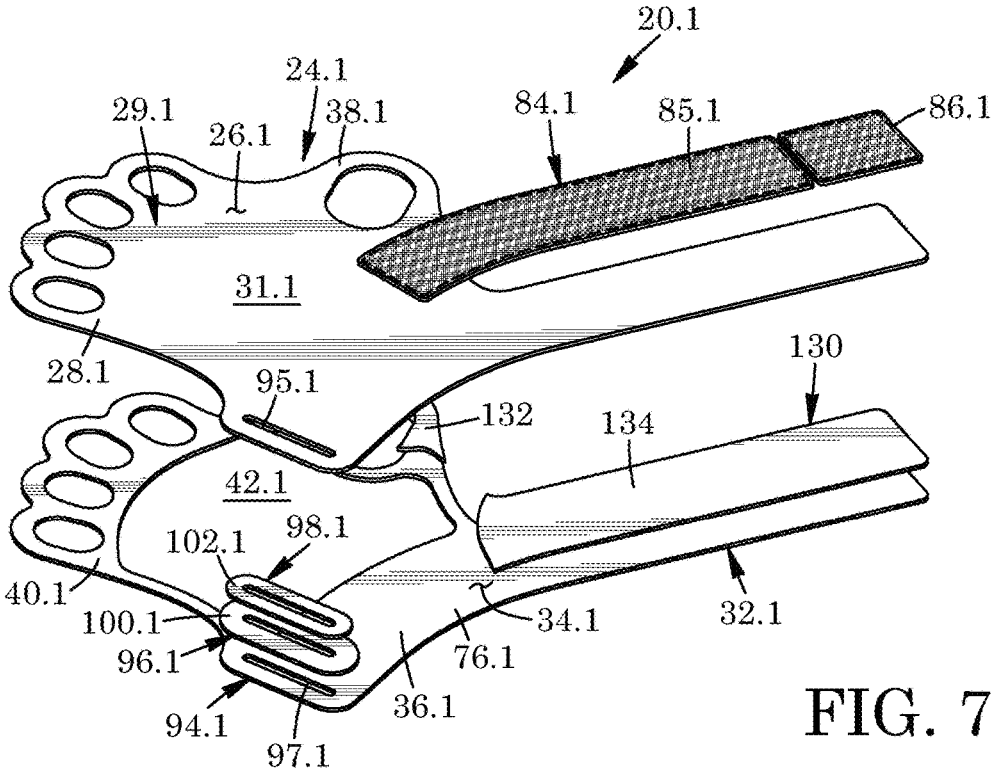
FIG. 7 is an exploded dorsal side perspective view of a left hand one of a pair of open-palmed gloves according to a second aspect, the gloves including a first layer of breathable material, a second layer comprising a lining, and an adhesive layer extending at least in part between the first layer thereof and the second layer thereof.
Figure 8:
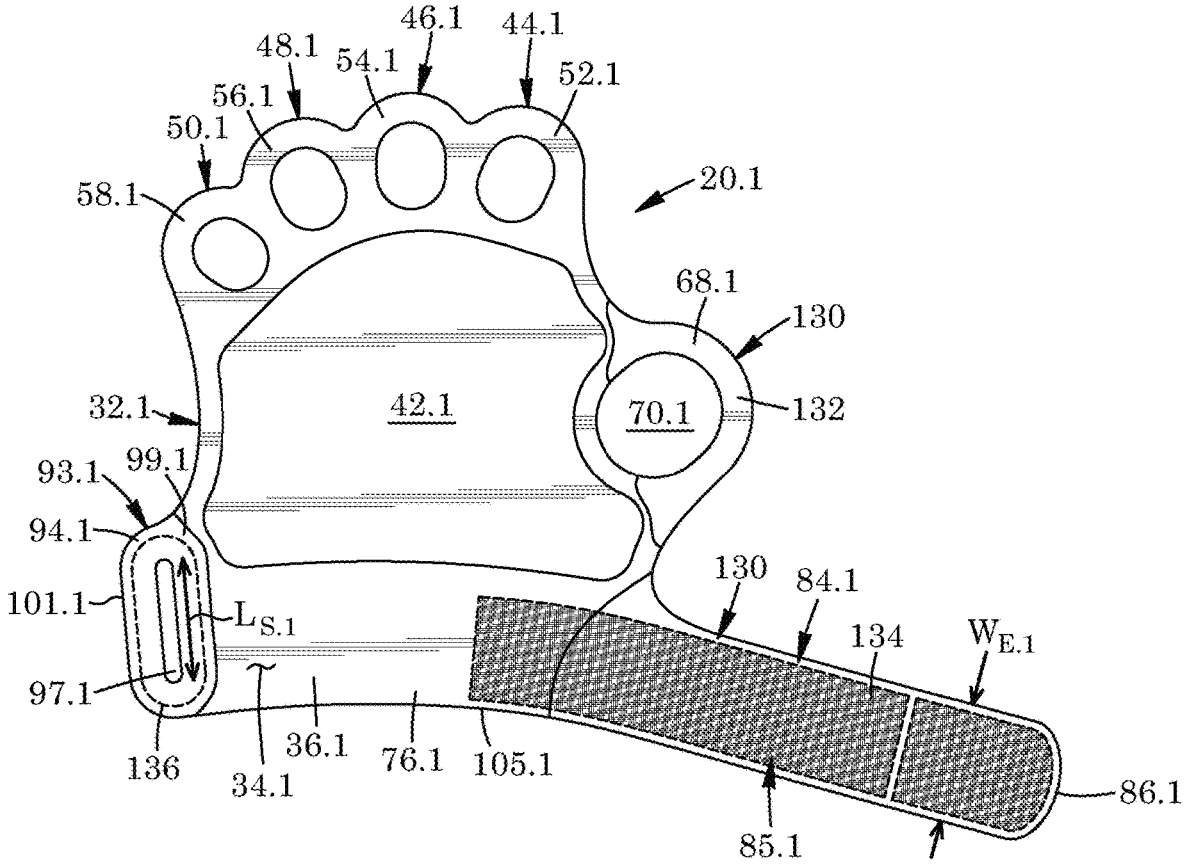
FIG. 8 is a plan view of the lining and adhesive layers of the glove of FIG. 7, with the first layer of breathable material not being shown.

FIGS. 7 to 8 show open-palmed gloves 20.1 according to a second aspect. Like parts have like numbers and functions as the gloves 20 and 22 shown in FIGS. 1 to 6 with the addition of decimal extension ".1". Gloves 20.1 are substantially the same as gloves 20 and 22 shown in FIGS. 1 to 6 with the following exceptions.

The gloves further include an adhesive layer 130 positioned between the first layer 26.1 of material 28.1 and the second layer 34.1 of material 36.1. The adhesive layer comprises three sub-portions 132, 134 and 136 in this example positioned along thumb portion 68.1 of the gloves 20.1, along straps 84.1 of the gloves, and along strap loops 94.1 of the gloves. Sub-portion 132 is c-shaped, sub-portion 134 is rectangular, and sub-portion 136 is loop-shaped in this example. The adhesive layer 130 has elastic properties which together with the lining provide edge stability and elasticity to the first layer 26.1 of material 28.1. The elastic adhesive layer functions to inhibit the first layer of material (e.g. leather, leather suede, synthetic leather, or microfiber) from stretching out or expanding in size over time. The elastic adhesive layer 130 inhibits the first layer of material from stretching out permanently and thus helps the glove retain its original shape.

Referring to FIG. 7, lining 40.1 with adhesive layer 130 thereon is placed on the first layer 26.1 of material 28.1. The materials according to one example are next heat pressed together, and optionally may be cold pressed together thereafter. However these means of coupling the materials together is not strictly required and other methods of combining the materials may be used in other embodiments.

Figure 9A:
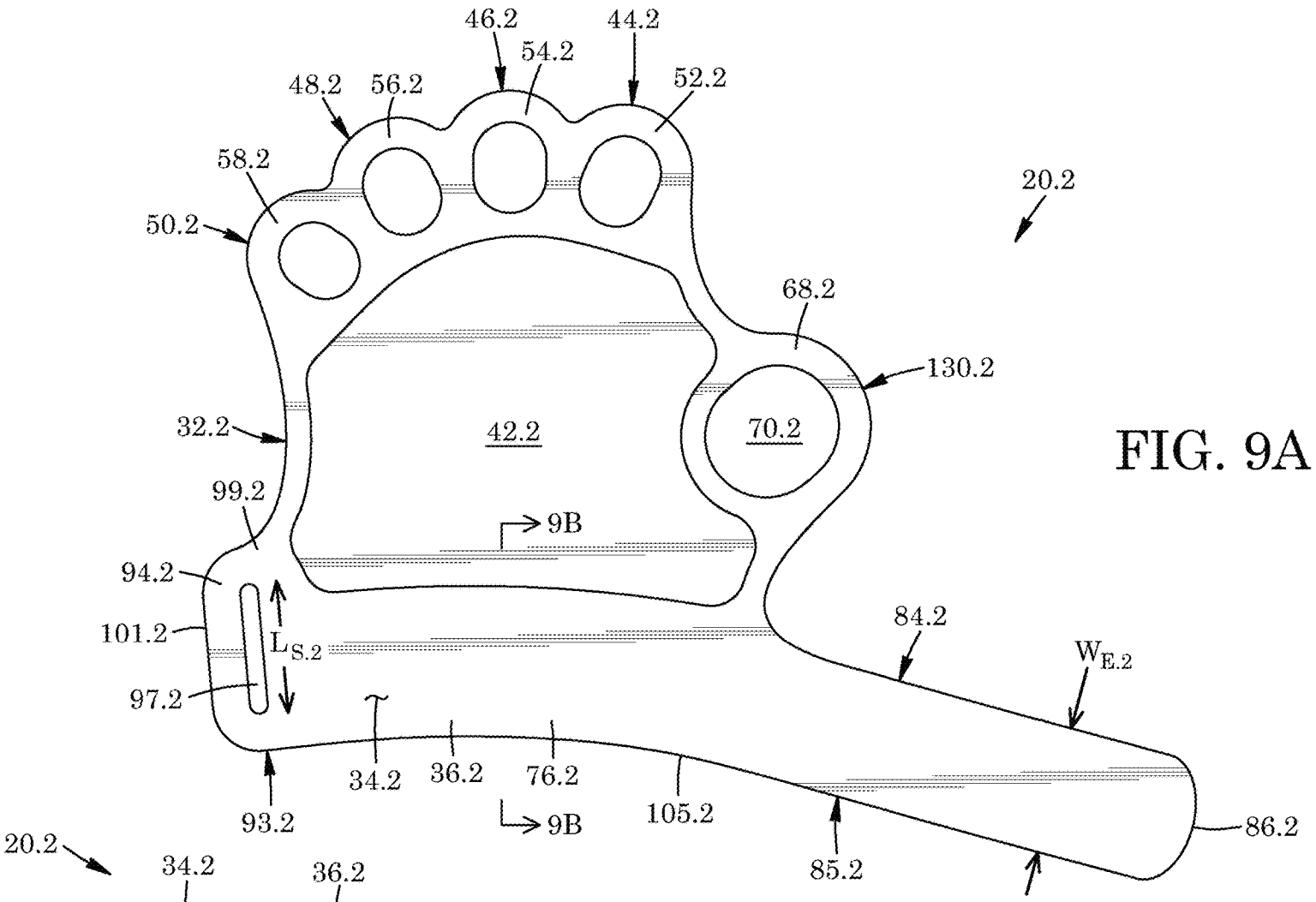
FIG. 9A is a plan view similar to FIG. 8 of the lining and adhesive layers of a glove according to a third aspect, with the first layer of breathable material of the glove not being shown.
Figure 9B:
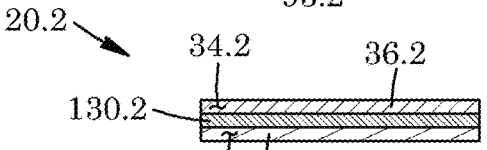
FIG. 9B is a sectional view taken along lines 9B-9B of the glove of FIG. 9A.

FIGS. 9A and 9B shows part of an open-palmed glove 20.2 according to a second aspect. Like parts have like numbers and functions as the gloves 20.1 shown in FIGS. 7 to 8 with decimal extension ".2" replacing decimal extension ".1". Gloves 20.2 are substantially the same as gloves 20.1 shown in FIGS. 7 to 8 with the following exception.

Adhesive layer 130.2 comprising a single continuous layer that covers the entirety of second layer 34.2 of material 36.2. The adhesive layer in this embodiment is thus coterminous with the first layer 26.2 of material 28.2 and second layer of material. The adhesive layer 130.2 so applied couples together the first layer of material and second layer 34.2 of material 36.2 and results in a glove 20.2 that is integrally connected together and which forms a unitary whole.

FIGS. 10 to 13 show an open-palmed glove 20.3 according to a fourth aspect. Like parts have like numbers and functions as the gloves 20 and 22 shown in FIGS. 1 to 6 with the addition of decimal extension ".3". Glove 20.3 is substantially the same as gloves 20 and 22 shown in FIGS. 1 to 6 with the following exceptions.

Figure 11:
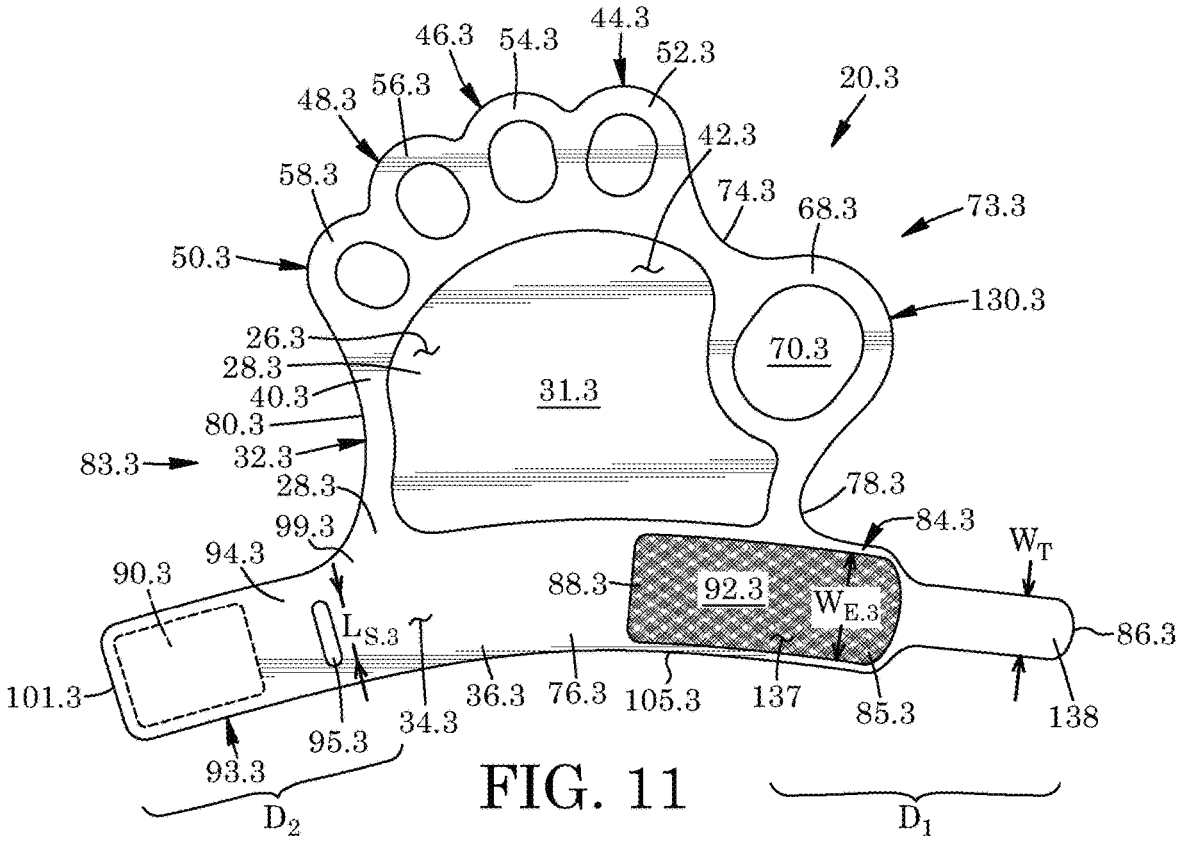
FIG. 11 is a palmar side plan view of the right hand one of a pair of open-palmed gloves of FIG. 10.

As seen in FIG. 11, strap 84.3 includes a pair of elongate portions 85.3 and 93.3 that extend longitudinally outwards opposite sides 73.3 and 83.3 of the glove 20.3. Elongate portion 85.3 of the strap has a sub-portion 137 having a width $W_{E.3}$ and upon which the second of the hook and loop fasteners 92.3 couples thereto. Elongate portion 85.3 of the strap includes a distally-positioned tab 138 which couples to, is integrally formed with and extends outwards from the sub-portion 137 thereof to the distal end 86.3 thereof. The tab has a width $W_T$. The width of tab 138 and length $L_{S.3}$ of slot 95.3 are less than the width $W_E$ of the sub-portion 137 of the strap 84.3. Elongate portion 85.3 of the strap 84.3 extends outwards from web 78.3 to distal end 86.3 thereof by a distance $D_1$.

Elongate portion 93.3 of the strap 84.3 has a distal end 101.3 that is spaced-apart from web 80.3 of the glove 20.3 by a distance $D_2$ that is generally equal to distance $D_1$; however this is not strictly required. The first of the hook and loop fasteners 90.3 couples to the elongate portion 93.3 of the strap in this example and extend from outer end 101.3 towards inner end 99.3 of the elongate portion of the strap. Slot 95.3 of elongate portion 93.3 is adjacent to the inner end of the elongate portion 93.3 of the strap and is positioned between the inner end and the outer end of the elongate portion.

Figure 10:
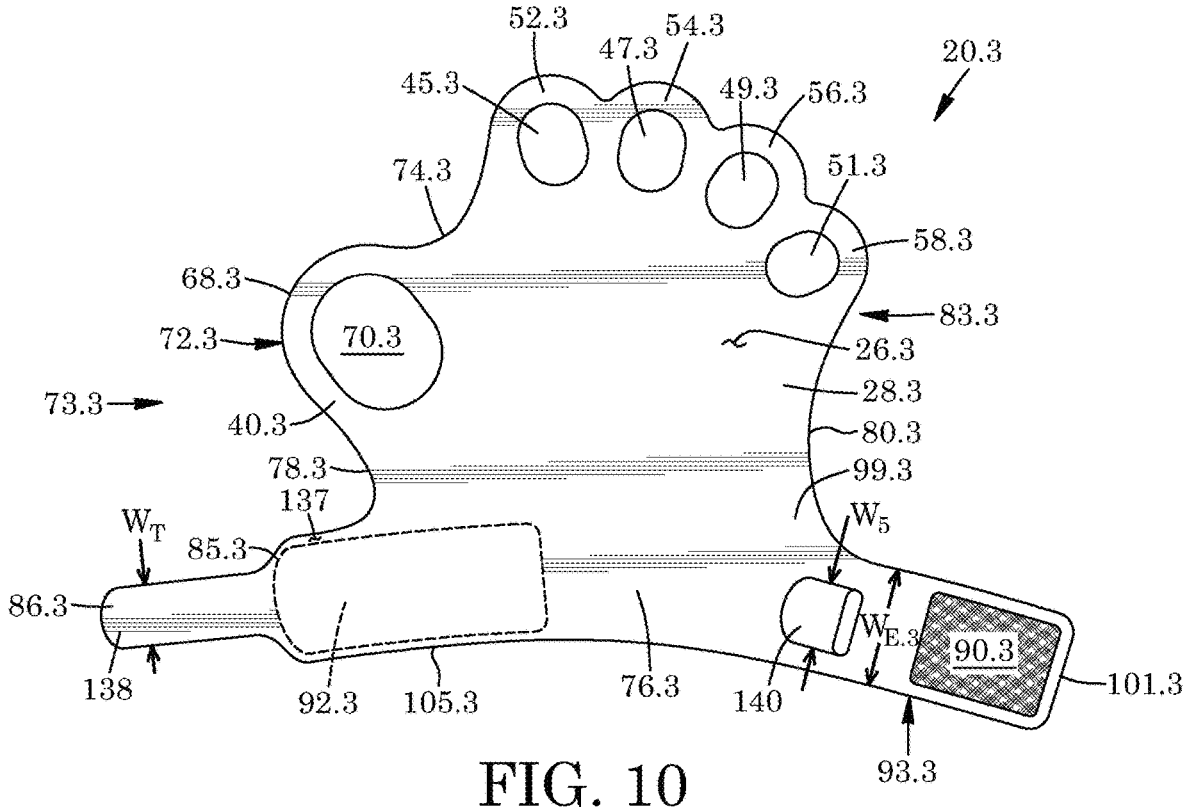
FIG. 10 is a dorsal side plan view of a right hand one of a pair of open-palmed gloves according to a fourth aspect.

As seen in FIG. 10, the elongate portion 93.3 of the strap 84.3 includes a tab receiving sub-portion 140 which is semi-obround in shape in this example; however this is not strictly required. The sub-portion of the elongate portion 93.3 of the strap has a width $W_S$ which is generally equal to the width $W_T$ of the tab 138. The sub-portion 140 of the elongate portion 93.3 of the strap may be of a color that matches that of the tab.

Figure 12:
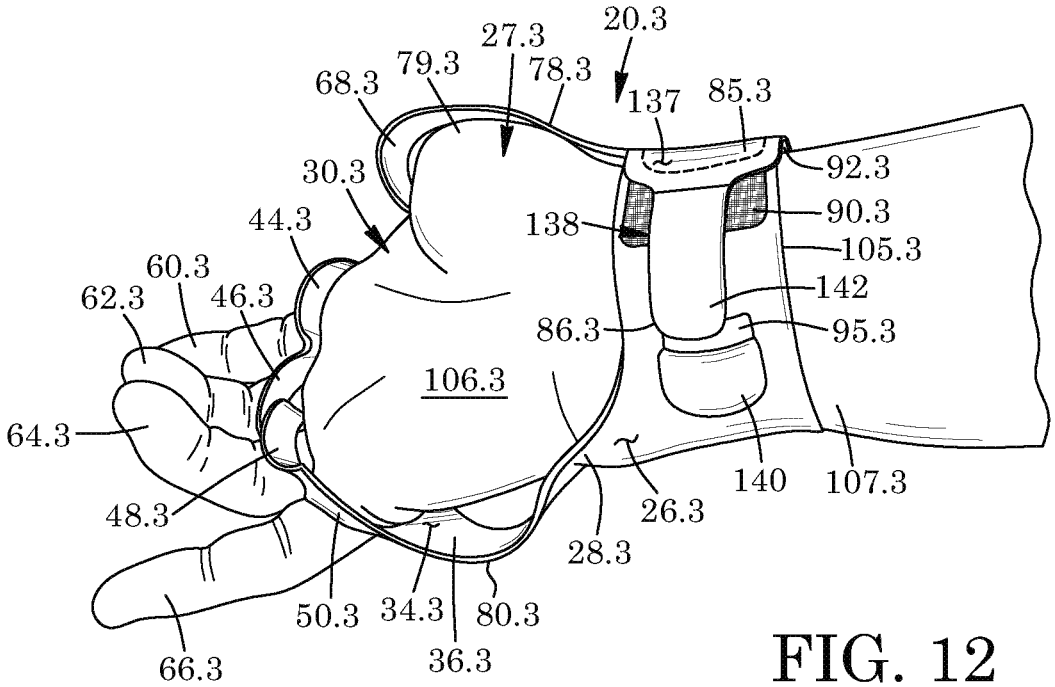
FIG. 12 shows a palmar perspective view of the right hand one of the gloves of FIG. 10 extending about a right hand of the person, with a strap of the glove shown partially wrapped around the wrist of the person and a distal end portion of the strap shown adjacent to a slot of the strap.
Figure 13:
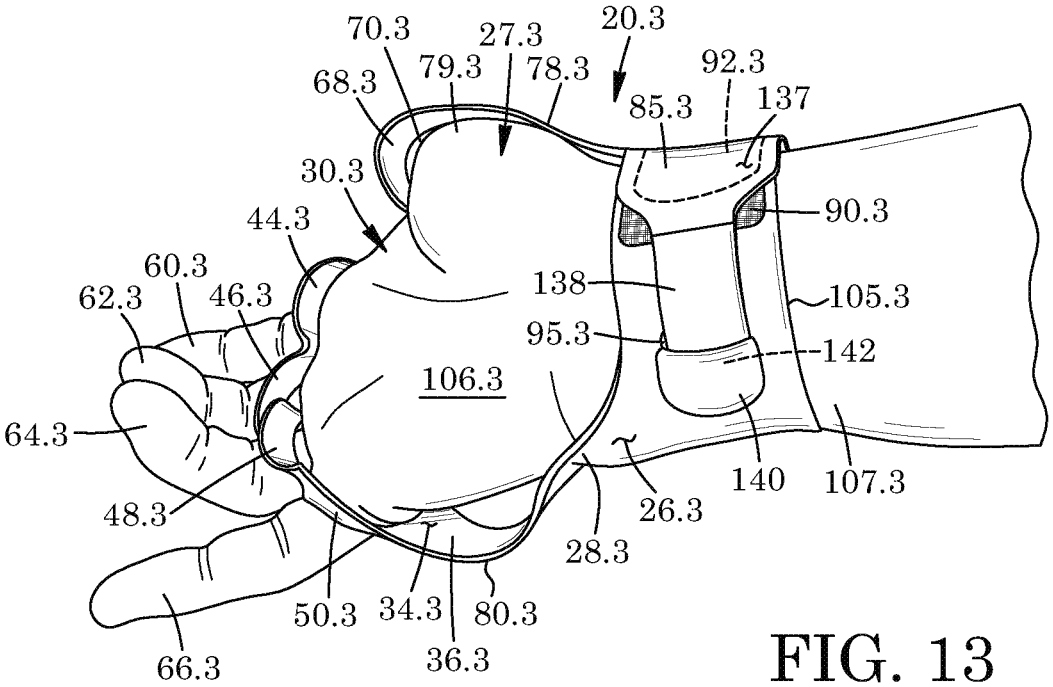
FIG. 13 shows a palmar perspective view of the right hand one of the gloves of FIG. 12 extending about the right hand of the person, with the strap of the glove shown fully wrapped around the wrist of the person and the distal end portion of the strap shown disposed within slot of the strap.

In operation and referring to FIG. 12, elongate portions 85.3 and 93.3 of strap 84.3 couple together via hook and loop fasteners 90.3 and 92.3. Upon the elongate portions of the strap being snugly coupled together about the wrist 107.3 of the hand 30.3, excess portion 142 of tab 138 is shaped to at least partially fit within the slot 95.3 when the elongate portions of the strap are coupled together. The sub-portion 140 of the elongate portion 93.3 of the strap 84.3 overlaps with and covers the excess portion 140 of the tab 138 so positioned, and mimics the shape of the excess portion so hidden.

ADDITIONAL DESCRIPTION

Examples of climbing gloves have been described. The following clauses are offered as further description.

(1) An open-palmed glove comprising: a first layer of material; and a second layer of material coupled to and extending about peripheral portions of the first layer of the material.

(2) The glove of clause 1 wherein the first layer of material and the second layer of material are co-planar at least in part when the glove is not in use.

(3) The glove of any preceding clause wherein the glove has a back with a central portion thereof consisting of said first layer of material.

(4) The glove of any preceding clause wherein the glove has finger portions and a strap portion both being made of said first layer of material and said second layer of material.

(5) The glove of any preceding clause wherein the first layer of material is breathable, configured to provide abrasion resistance, and configured to stretch and mold to one's hand (6) The glove of any preceding clause wherein the first layer of material consists of leather.

(7) The glove of any preceding clause wherein the first layer of material is made of leather.

(8) The glove of any one of clauses 1 to 7 wherein the first layer of material is made of leather suede.

(9) The glove of any one of clauses 1 to 7 wherein the first layer of material is made of synthetic leather.

(10) The glove of any one of clauses 1 to 7 wherein the first layer of material is made of microfiber.

(11) The glove of any preceding clause wherein the second layer of material functions to reinforce the first layer of material.

(12) The glove of any preceding clause wherein the second layer of material is a lining.

(13) The glove of any preceding clause wherein the second layer of material comprises a flexible polymer.

(14) The glove of any preceding clause wherein the second layer of material comprises a flexible laminate.

(15) A glove having an open palm and a back opposite the open palm, and comprising: finger and strap portions made of one or more reinforcing materials; and a central portion extending along the back of the glove, the central portion consisting of a single layer of material.

(16) The glove of clause 15, wherein the single layer of material is made of leather.

(17) The glove of clause 15, wherein the single layer of material is made of leather suede.

(18) The glove of clause 15, wherein the single layer of material is made of synthetic leather.

(19) The glove of clause 15, wherein the single layer of material is made of microfiber.

(20) The glove of any one of clauses 15 to 19 wherein the one or more reinforcing materials comprises a flexible, high-strength polymer.

(21) An open-palmed glove comprising: a first member made of one of leather, leather suede, synthetic leather, and microfiber, with a central portion of a back of the glove consisting of said first member; and a second member made of a reinforcing material, the second member being co- with and coupling to the first member, and the second member extending about finger and strap portions of the glove.

(22) The glove of clause 21 wherein the second member extends about peripheral portions of the first member.

(23) The glove of any one of clauses 21 to 22, wherein the second member has an aperture which extends about said central portion of the glove.

(24) An open-palmed glove comprising: a single material in the form of one of leather, leather suede, synthetic leather, and microfiber; and a lining coupled to said single material, the lining forming an aperture aligned with the back of the glove such that the back of the glove consists of said single material and is unlined.

(25) An open-palmed glove comprising: a dorsal portion consisting of a single layer of a first material; a plurality of finger portions coupled to a first peripheral edge of the dorsal portion of the glove, the finger portions being made of at least a second material and a strap portion coupled to a second peripheral edge of the dorsal portion of the glove, the strap portion being made of at least said second material.

(26) Use of an open-palmed glove of any preceding clause for rock climbing, wherein said glove consists of a single material on the back thereof, said single material touching both the hand and the rock that is being climbed.

(27) The use of clause 26 wherein said single material is leather, leather suede, synthetic leather, or microfiber.

(28) A kit comprising a plurality of pairs of rock-climbing gloves of different sizes and of the type of any preceding clause, wherein each said size of rock-climbing gloves has its own color which corresponds to a color of a camming device.

It will be appreciated that many variations are possible within the scope of the invention described herein. It will also be understood by someone skilled in the art that many of the details provided above are by way of example only and are not intended to limit the scope of the invention which is to be determined with reference to at least the following claims.

What is claimed is:

1. An open-palmed glove comprising:

a first layer of material;

a second layer of material coupled to and extending only about peripheral portions of the first layer of the material;

wherein the glove includes a strap portion, finger portions spaced-apart from the strap portion thereof, a thumb region and a pinky region spaced from the thumb region thereof; and wherein the glove has a back with a central portion thereof consisting of said first layer of material, the central portion of the glove extending from adjacent the thumb region of the glove to below the pinky region of the glove, the central portion of the glove extending between the strap portion and the finger portions of the glove, and the second layer of material enclosing the central portion of the glove.

2. The open-palmed glove as claimed in claim 1, wherein the second layer of material forms an aperture aligned with the back of the glove such that the back of the glove consists of said first layer of material and is unlined.

3. The open-palmed glove as claimed in claim 1, wherein the finger portions of the glove are made of at least said first layer of material and said second layer of material, and wherein the strap portion of the glove is made of at least said first layer of material and said second layer of material.

4. The open-palmed glove as claimed in claim 1, wherein the first layer of material is one of leather, leather suede, synthetic leather, and microfiber, and wherein the second layer of material comprises a lining.

5. The open-palmed glove as claimed in claim 1, wherein the second layer of material comprises one of a thin knit said material, a thin woven said material, a thin non-woven said material and a thin polymer.

6. The open-palmed glove as claimed in claim 1, wherein the first layer of material is made of a first said material and the second layer of material is made of at least a second said material, wherein the glove includes a dorsal portion consisting of said first layer of material, wherein the finger portions of the glove are formed by said second layer of material, with the finger portions coupling to a first peripheral edge of the dorsal portion of the glove, and wherein the strap portion of the glove is formed by said second layer of material, with the strap portion coupling to a second peripheral edge of the dorsal portion of the glove.

7. The open-palmed glove as claimed in claim 1, wherein the finger and strap portions of the glove are made of a reinforcing material comprising said second layer of material.

8. The open-palmed glove as claimed in claim 7, wherein the glove further includes an adhesive layer having elastic properties and positioned between said first layer of material and said second layer of material, and wherein the adhesive layer together with the reinforcing material are configured to provide edge stability and elasticity to the first layer of material.

9. The open-palmed glove as claimed in claim 1, wherein the glove is configured for crack climbing.

10. The open-palmed glove as claimed in claim 1, wherein the first layer of material and the second layer of material are co-planar when the glove is not in use.

11. The open-palmed glove as claimed in claim 1, wherein the glove has a plurality of apertures extending through a distal region of the glove, with the apertures extending from a dorsal side to a palmar side of the glove.

12. The open-palmed glove as claimed in claim 1, wherein the central portion of the glove is shaped to extend along a dorsal side of the hand.

13. The open-palmed glove as claimed in claim 1, wherein the glove includes one or more first elongate connector portions adjacent the thumb region of the glove, wherein the glove includes a second elongate connector portion adjacent the pinky region of the glove, wherein the one or more first elongate connector portions and the second elongate connector portion extend between and couple together the strap portion and the finger portions of the glove, and wherein the central portion of the glove is positioned between the one or more first elongate connector portions and the second elongate connector portion.

14. The open-palmed glove as claimed in claim 1, wherein the glove includes one or more first elongate connector portions adjacent the thumb region of the glove, wherein the glove includes a second elongate connector portion adjacent the pinky region of the glove, and wherein the one or more first elongate connector portions and the second elongate connector portion of the glove are outwardly concave.

15. The open-palmed glove as claimed in claim 1, wherein the glove includes a first elongate connector portion coupling together and extending between the strap portion and the thumb region of the glove, wherein the glove includes a second elongate connector portion coupling together and extending between the thumb region and the finger portions of the glove, wherein the glove includes a third elongate connector portion coupling together and extending between the strap portion and the pinky region of the glove and wherein the central portion of the glove is positioned between the first elongate connector portion, the second elongate connector portion and the third elongate connector portion of the glove.

16. The open-palmed glove as claimed in claim 1, wherein the glove is outwardly concave between the strap portion and the thumb region of the glove, wherein the glove is outwardly concave between the thumb region and the finger portions of the glove and wherein the glove is outwardly concave between the strap portion and the pinky region of the glove.

17. The open-palmed glove as claimed in claim 1, further including an adhesive layer positioned between the first layer of material and the second layer of with the adhesive layer having elastic properties and wherein the adhesive layer together with the second layer of material are configured to provide edge stability and elasticity to the first layer of material.

18. The open-palmed glove as claimed in claim 17, wherein the adhesive layer is configured to inhibit the first layer of material from expanding in size permanently over time and thus helps the glove retain its original shape.

19. A kit comprising a plurality of pairs of the open-palmed glove of different sizes and colors and as claimed in claim 1, wherein each said size of the open-palmed glove has its own said color which corresponds to a color of a corresponding one of a plurality of camming devices of different sizes and colors.

* * * * *